US006926254B1

(12) United States Patent
Nymann

(10) Patent No.: US 6,926,254 B1
(45) Date of Patent: Aug. 9, 2005

(54) JACK FOR HEAVY OBJECTS

(76) Inventor: Robert Nymann, 1306 Melville Dr., Las Vegas, NV (US) 89102

( * ) Notice: Subject to any disclaimer, the term of this patent is extended or adjusted under 35 U.S.C. 154(b) by 0 days.

(21) Appl. No.: 10/793,443

(22) Filed: Mar. 4, 2004

(51) Int. Cl.[7] ..... B25B 11/00
(52) U.S. Cl. ..... 254/8 R; 254/124; 254/133 R
(58) Field of Search ..... 254/8 R, 133 R, 254/134, 2 B, 93 H, 89 HP, 93 R, 10 B, 254/124

(56) References Cited

U.S. PATENT DOCUMENTS 3,844,421 A * 10/1974 Nielsen ..... 414/678
3,958,793 A * 5/1976 Garate ..... 254/10 B
4,724,930 A * 2/1988 VanLierop ..... 187/204
5,372,353 A * 12/1994 West ..... 254/10 B
6,338,470 B1 * 1/2002 Steely et al. ..... 254/124
6,343,556 B1 2/2002 Lanphear
6,601,430 B2 8/2003 McClellan
6,779,780 B2 * 8/2004 Arzouman ..... 254/8 B

* cited by examiner

*Primary Examiner*—Lee D. Wilson
(74) *Attorney, Agent, or Firm*—Rob L. Phillips; Quirk & Tratos

(57) ABSTRACT

A transmission jack and apparatus that can raise and lower heavy objects between a floor surface and a higher elevation is disclosed. The transmission jack and apparatus includes a bottom frame mounted on a plurality of wheels. Pivotally attached to the bottom frame is a pair of hinge elements that support a plurality of support bars, with the support bars always remaining parallel to a ground surface. The support bars can be raised or lower through a pair of metal cylinders and internal rods which are hooked up to a hydraulic pump. A handle attached to the hydraulic pump allows an individual to raise or lower the plurality of support bars by pumping an oil-based hydraulic fluid into the pair of metal cylinders, thereby pushing the out the internal rods, which then engage the hinge elements.

4 Claims, 9 Drawing Sheets

JACK FOR HEAVY OBJECTS

BACKGROUND OF THE INVENTION

The present invention is that of a new and improved transmission jack and apparatus that can raise and lower heavy objects between a floor surface and a higher elevation.

DESCRIPTION OF THE PRIOR ART

U.S. Pat. No. 6,601,430, issued to McClellan, discloses a lifting platform with a scissor type jack.

U.S. Pat. No. 6,343,556, issued to Lanphear, discloses an adjustable height table that includes a base frame, a slider frame assembly, a generally planar support surface and a lifting mechanism.

SUMMARY OF THE INVENTION

The present invention is that of a new and improved transmission jack and apparatus that can raise and lower heavy objects between a floor surface and a higher elevation. The transmission jack and apparatus comprises a bottom frame mounted on a plurality of wheels. Pivotally attached to the bottom frame is a pair of hinge elements that support a plurality of support bars, with the support bars always remaining parallel to a ground surface. The support bars can be raised or lower through a pair of metal cylinders and internal rods which are hooked up to a hydraulic pump. A handle attached to the hydraulic pump allows an individual to raise or lower the plurality of support bars by pumping an oil-based hydraulic fluid into the pair of metal cylinders, thereby pushing the out the internal rods, which then engage the hinge elements.

There has thus been outlined, rather broadly, the more important features of a transmission jack and apparatus that can raise and lower heavy objects between a floor surface and a higher elevation in order that the detailed description thereof that follows may be better understood and in order that the present contribution to the art may be better appreciated. There are, of course, additional features of the transmission jack and apparatus that can raise and lower heavy objects between a floor surface and a higher elevation that will be described hereinafter and which will form the subject matter of the claims appended hereto.

In this respect, before explaining at least one embodiment of the transmission jack and apparatus that can raise and lower heavy objects between a floor surface and a higher elevation in detail, it is to be understood that the transmission jack and apparatus that can raise and lower heavy objects between a floor surface and a higher elevation is not limited in its application to the details of construction and to the arrangements of the components set forth in the following description or illustrated in the drawings. The transmission jack and apparatus that can raise and lower heavy objects between a floor surface and a higher elevation is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present transmission jack and apparatus that can raise and lower heavy objects between a floor surface and a higher elevation. It is important, therefore, that the claims be regarded as including such equivalent constructions insofar as they do not depart from the spirit and scope of the present invention.

It is therefore an object of the present invention to provide a transmission jack and apparatus that can raise and lower heavy objects between a floor surface and a higher elevation which has all of the advantages of the prior art and none of the disadvantages.

It is another object of the present invention to provide a transmission jack and apparatus that can raise and lower heavy objects between a floor surface and a higher elevation which may be easily and efficiently manufactured and marketed.

It is another object of the present invention to provide a transmission jack and apparatus that can raise and lower heavy objects between a floor surface and a higher elevation which is of durable and reliable construction.

It is yet another object of the present invention to provide a transmission jack and apparatus that can raise and lower heavy objects between a floor surface and a higher elevation which is economically affordable and available for relevant market segments of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1A:
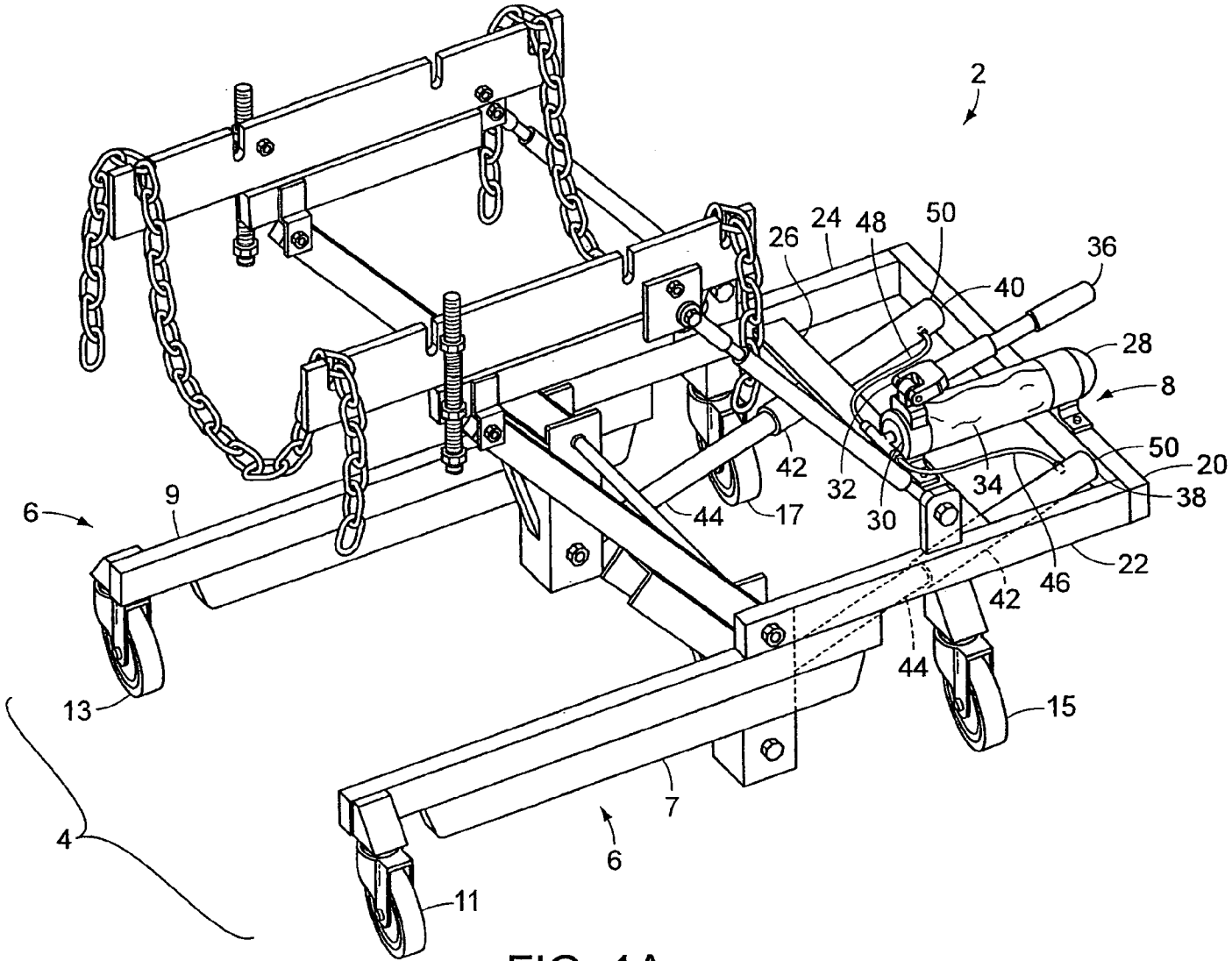
FIG. 1A shows a perspective view of the present invention in an upright position.
Figure 1B:
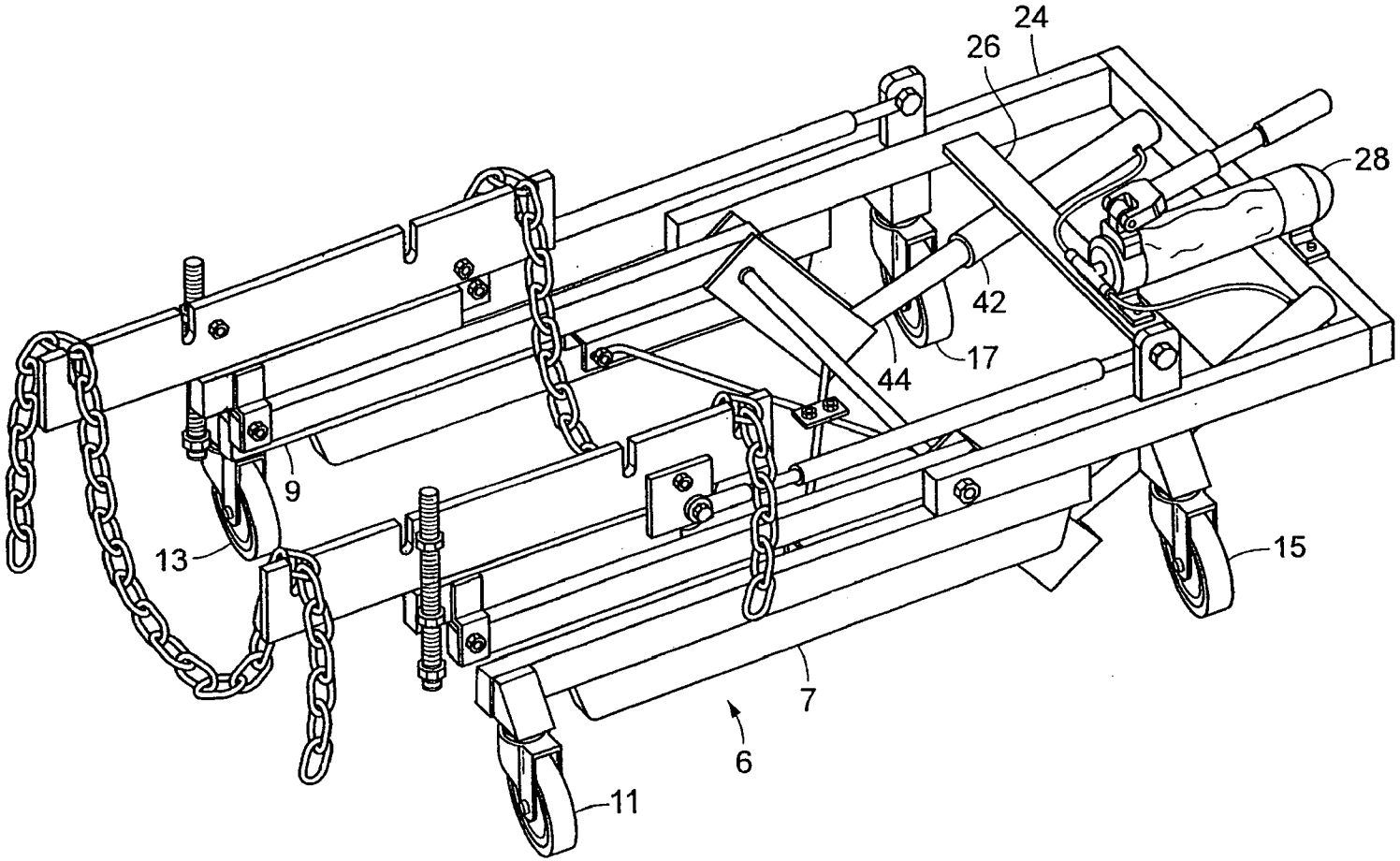
FIG. 1B shows a perspective view of the present invention in a lowered position.

FIG. 1A shows a perspective view of the present invention in an upright position, while FIG. 1B shows a perspective view of the present invention in a lowered position. The present invention is essentially a transmission & parts assistance apparatus 2 that is used in conjunction with vehicles, preferably trucks and automobiles. The present invention works best when using the apparatus 2 to lift a transmission off of a floor into an off-the-floor position for either working on the transmission or other heavy parts or assist an individual in placing the transmission back within an automobile. The apparatus 2 can be also used in the reverse context to lower a removed heavy object to ground level. Alternatively, the apparatus 2 could be used to lower or raise other items of heavy equipment that are not necessarily limited to automobile or truck components.

Apparatus 2 comprises a bottom frame 4 that has two ends, a front end and a rear end, and has two sides, a left side and a right side. Bottom frame 4 is comprised of two separate portions which comprise a support frame 6 and a mounting frame 8. Support frame 6 itself comprises a left bar 7 and a right bar 9, with each bar having two ends, a first end and a second end. Rotatable wheels 11 and 13 are attached to the first end of left bar 7 and right bar 9, respectively, while the second end of each bar is fixedly attached to the mounting frame 8. Rotatable wheels 11 and 13 can also be designed to be castor wheels.

The mounting frame 8 has is a U-shaped bracket that comprises a front mounting bracket 20, a left mounting bracket 22, and a right mounting bracket 24. Each bracket of the mounting frame 8 has two ends, a first end and a second end, and furthermore, has two side surfaces, a top side surface and a bottom side surface. Furthermore, each bracket of the mounting frame 8 has two sides, an inner side and an outer side.

The second end of the left mounting bracket 22 is fixedly attached to the first end of the front mounting bracket 20, while the second end of the right mounting bracket 24 is fixedly attached to the second end of the front mounting bracket 20. Left mounting bracket 22 and right mounting bracket 24 are parallel to one another, giving the mounting frame 8 a U-shape. The second end of the left bar 7 is fixedly attached to the bottom side surface of the left mounting bracket 22, while the second end of the right bar 9 is fixedly attached to the bottom side surface of the right mounting bracket 24. Wheels 15 and 17 are rotatably attached to the bottom side surface of left mounting bracket 22 and right mounting bracket 24, respectively. Rotatable wheels 15 and 17 can also be designed to be castor wheels.

Additional framing elements are present. Support bracket 26 has two ends, a first end and a second end, and furthermore, has two side surfaces comprising a top side surface and a bottom side surface. The first end of support bracket 26 is attached to the inner side of the left mounting bracket 22, while the second end of support bracket 26 attached to the inner side of the right mounting bracket 24.

Hydraulic pump 28 is mounted on the top side surface of support bracket 26 and the top side surface of front mounting bracket 20. Pump 28 has two ends, a first end and a second end, with the first end having an opening 30 to which a T-joint 32 is attached. Pump 28 has a volume of hydraulic fluid 34 located within it, with the hydraulic fluid 34 preferably being some oil-based product. Lever 36, having two ends, an attached end and a free end, has the attached end pivotally attached to the hydraulic pump 28 near the first end of the pump 28.

Apparatus 2 has two metal cylinders 38 and 40 which each have two ends, a first end and a second end. The second end of each cylinder is attached to the inner side surface of the front mounting bracket 20, with each cylinder facing slightly downward going from the second end to the first end of each cylinder. The first end of each cylinder has an opening 42, with a cylindrical metal rod 44 located within it.

Tubes 46 and 48 each have two ends, a first end and a second end, with the first end of each tube connected to the T-joint. The second end of tube 46 is attached to the cylinder 38 near the second end of cylinder 38, while the second end of tube 48 is attached to the cylinder 40 near the second end of the cylinder 40. The second end of each tube has an internal cavity 50 which is contiguous with the inside of the appropriately attached tube and the volume of hydraulic fluid 34 located within the hydraulic pump 28.

By grasping the free end of the lever 36 and pumping in an up-and-down manner, a small amount of volume of hydraulic fluid 34 is ejected from the hydraulic pump 28 and travels through the tubes 46 and 48 into the cylinders 38 and 40. This causes the pressure within each cavity 50 to build to an extent, causing the pressure to push the two rods 44 outward. To relieve the pressure on the rods 44, an individual can grasp the free end of the lever 36 and twist it slightly, allowing the hydraulic fluid within the cavities 50 to have an opening to travel back within the hydraulic pump 28.

Figure 2:
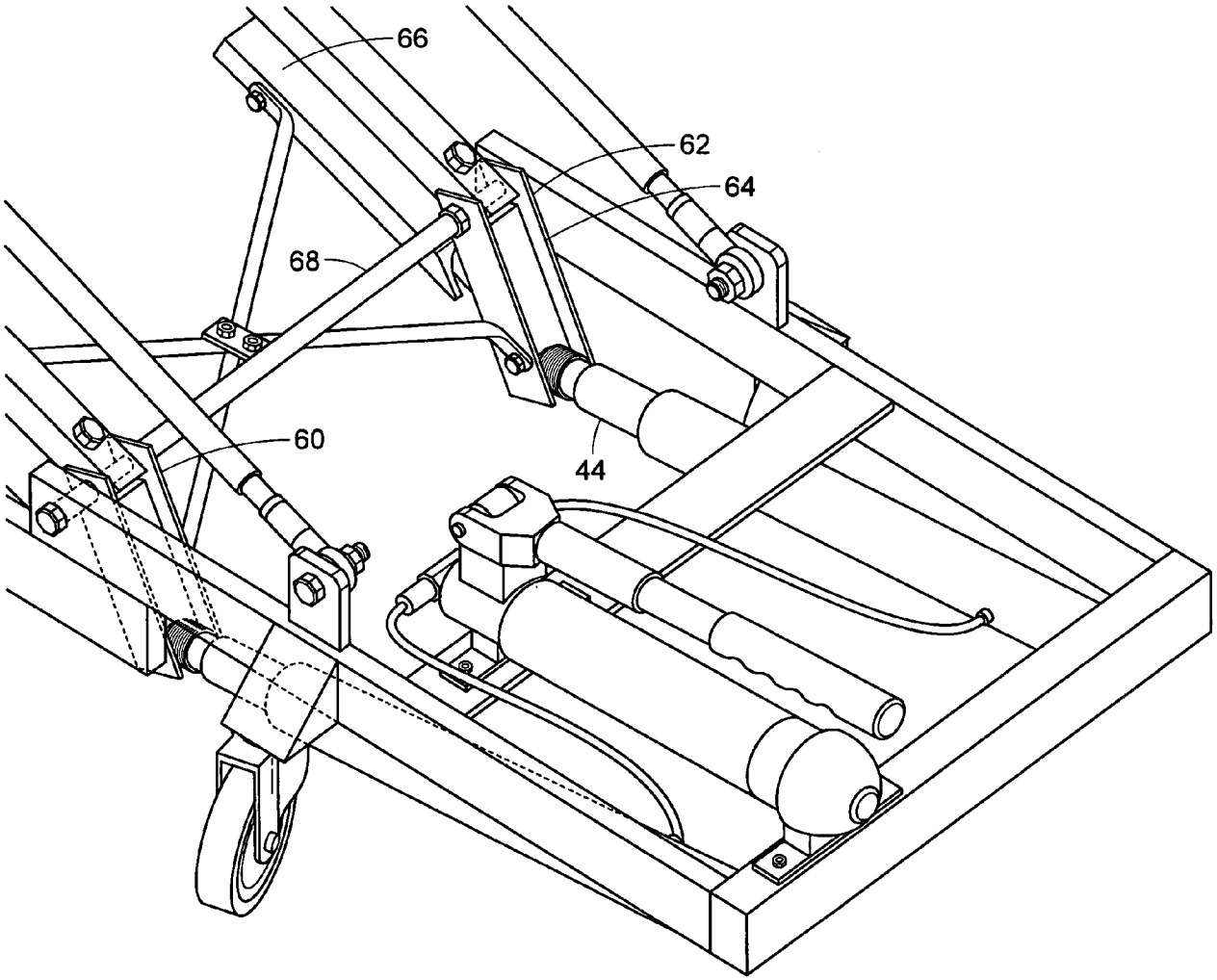
FIG. 2 shows a close-up perspective view of the left and right hinge elements of the present invention.

Referring now to FIG. 2, apparatus 2 also has two hinge elements comprising a left hinge element 60 and a right hinge element 62. The second end of a rod 44 is shown attached to hinge element 62. Each hinge element has two portions, a front hinge element 64 and a rear hinge element 66, with each of these two pieces having two ends, a first end and a second end. The first end of each rear hinge element 66 is fixedly attached to the second end of the front hinge element 64 at about a 120 degree angle. The second end of rod 44 is attached to the first end of the front hinge element 64. Hinge mounting rod 68 has two ends, a first end and a second end, with the first end of the hinge mounting rod 68 fixedly attached to the inner side of left mounting bracket 22, while the second end of the hinge mounting rod 68 is fixedly attached to the inner side of right mounting bracket 24. The second end of the front hinge element 64 of left hinge element 60 is mounted on the hinge mounting rod 68 near the first end of the hinge mounting rod 68, while the second end of the front hinge element 64 of right hinge element 62 is mounted on the hinge mounting rod 68 near the second end of the hinge mounting rod 68.

As can be seen in FIG. 2, inward or outward movement of the second end of a rod 44 causes the hinge element 62 to move about its attachment point on the hinge mounting rod 68. When the second end of rod 44 pushes the first end of the front hinge element 64 inward and downward, the second end of each rear hinge element 66 goes upward.

Figure 3:
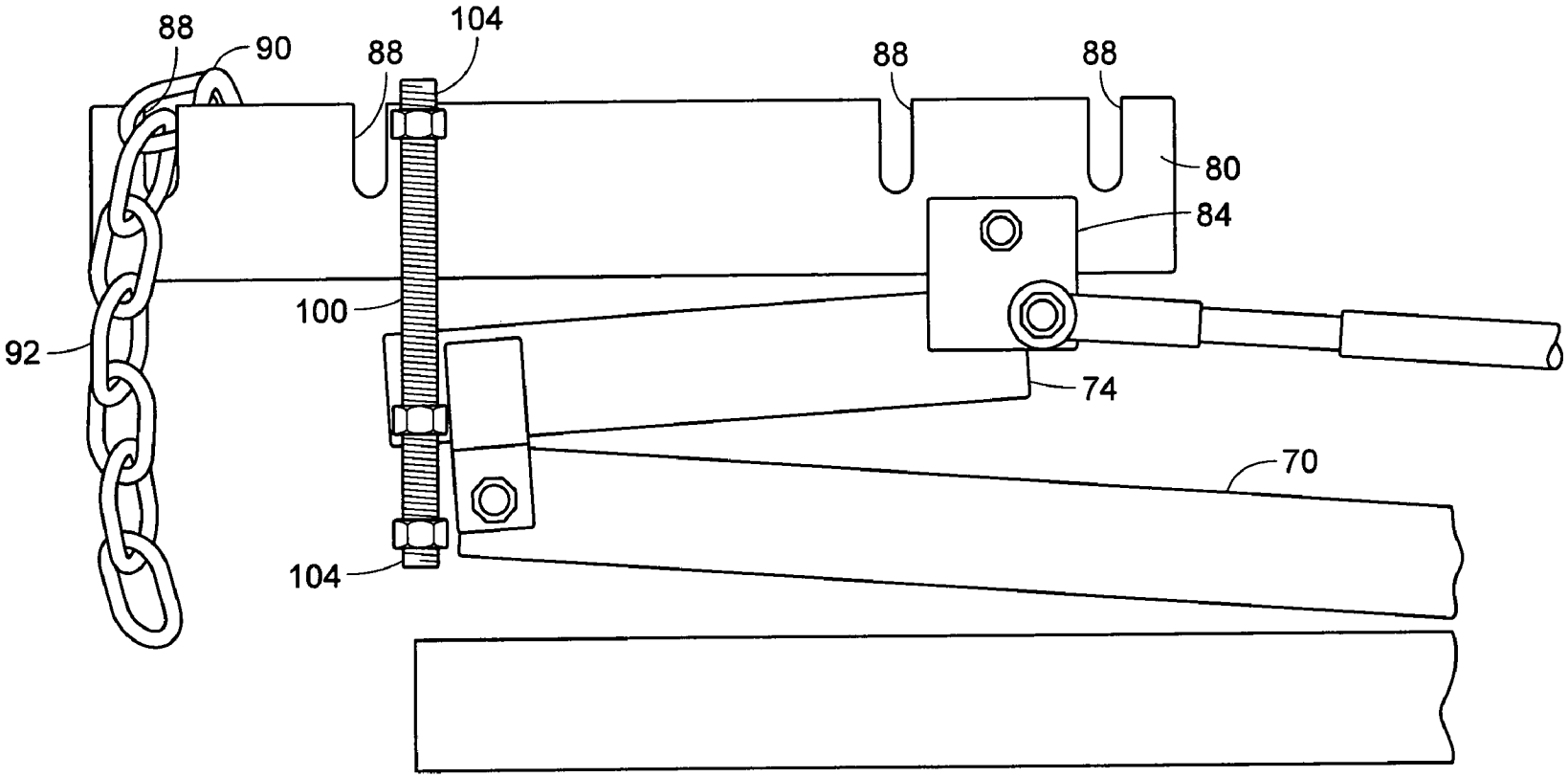
FIG. 3 shows a side view of the support bars used to successfully hold a transmission or other heavy object.
Figure 4:
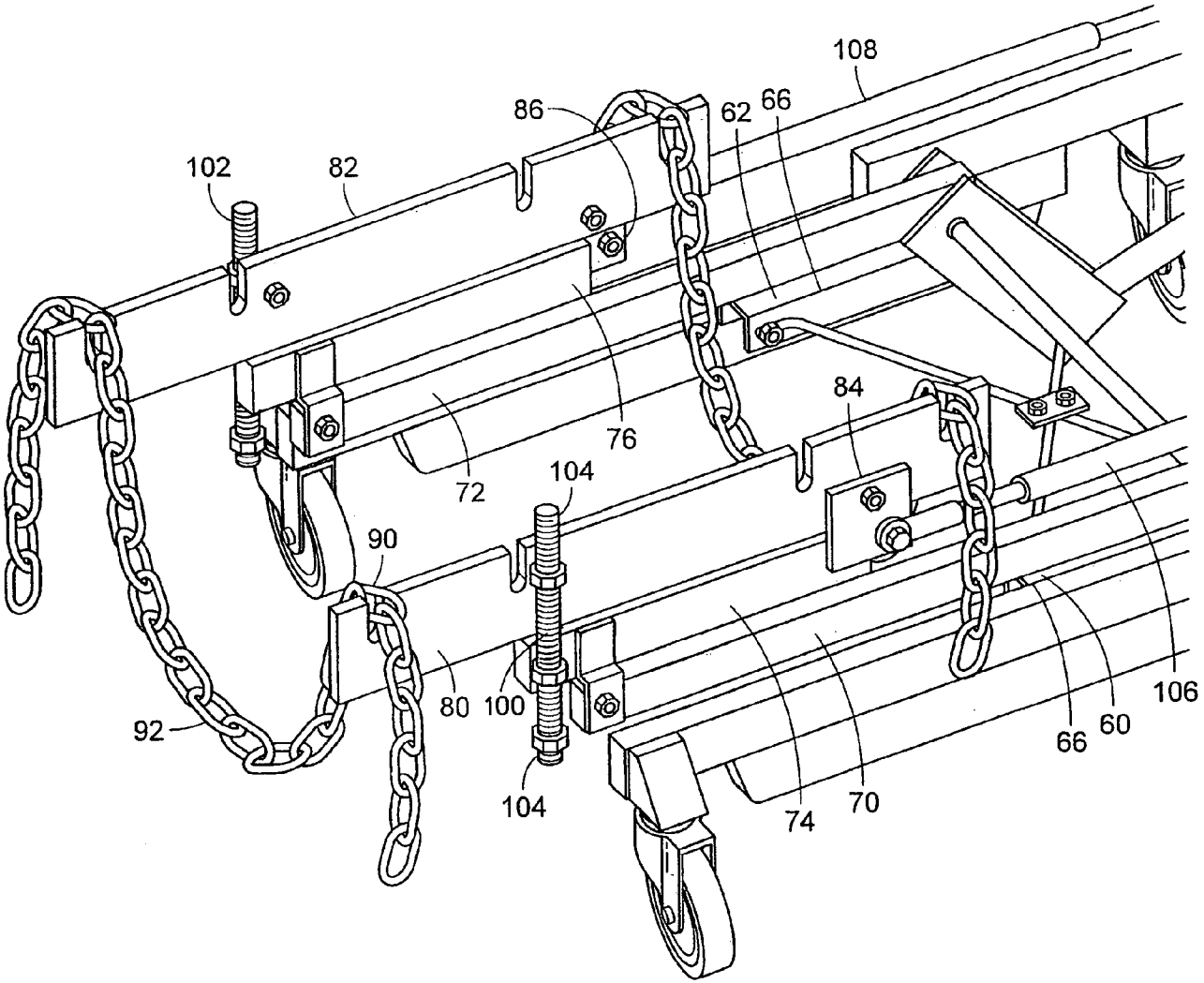
FIG. 4 shows a perspective view of the support bars used to successfully hold a transmission or other heavy object.

FIGS. 3 and 4 show a side views and perspective views, respectively, of the support bars used to successfully hold a transmission or other heavy object. First level support bars 70 and 72 each have two end, a first end and a second end. The first end of first level support bar 70 is attached to the top side of the rear hinge element 66 of hinge element 60, while the first end of the first level support bar 72 is attached to the top side of the rear hinge element 66 of hinge element 62.

Second level support bars 74 and 76 each have two end, a first end and a second end. The second end of second level support bar 74 is pivotally attached to second end of first level support bar 70, and is located above the first level support bar 70. Furthermore, the second end of second level support bar 76 is pivotally attached to second end of first level support bar 72, and is located above the first level support bar 72.

Top level support bars 80 and 82 each have two end, a first end and a second end. The first end of second level support bar 74 is fixedly attached to the first end of top level support bar 80 by bracket 84 and is located above the second level support bar 74. The first end of second level support bar 76 is fixedly attached to the first end of top level support bar 82 by bracket 86 and is located above the second level support bar 76. Each connection point between the top level support bars 80 and 82 with the second level support bars 74 and 76 is only slightly pivotal. Brackets 84 and 86, respectively, allow the second end of each top level support bar to move upward or downward a little bit, but the second end of each second level support bar is immobile and generally is not pivotable about the brackets.

Top level support bars 80 and 82 each have two sides, a top end and a bottom end, and furthermore, have two sides, an inner side and an outer side. The top end of each top level support bar has several ovaloid grooves 88, with each groove designed to allow a chain 90 from a chain link 92 to be placed into it.

Threaded rods 100 and 102 are present to provide support to the top level support bars 80 and 82 once a transmission is placed on top of them. Threaded rod 100 is attached to the outer side of top level support bar 80 and the second level support bar 74 near the second end of each, while threaded rod 102 is attached to the outer side of top level support bar 82 and the second level support bar 76 near the second end of each. Nuts 104 are fixedly attached to both the second ends of threaded rods 100 and 102 and the second ends of second level support bars 74 and 76. The middle nut 104 on each of the threaded rods 100 and 102 are attached to a location on the threaded rods 100 and 102 that have right-handed threaded, while the top nut 104 on each of the threaded rods 100 and 102 are attached to a location on the threaded rods 100 and 102 that have left-handed threaded.

Once each threaded rod is inserted through a set of nuts on the second end of a particular second level support bar and the second end of a particular top level support bar, then each threaded rod provides adjustment to perfectly align the transmission into its recess and also to provide extra stability and support to the apparatus 2 once it is holding a transmission.

Side support bars 106 and 108 provide stability and keeps bars 80, 82, 74, and 76 in a level position when raised or lowered, as determined by the weight of the part. These support bars are clearly shown in FIGS. 4 and 5, which shows a perspective close-up view of side support bar 108. Side support bars 106 and 108 each have two ends, a first end and a second end, with the first end of the side support bar 106 being attached to the outer side of the top level support bar 80 near the first side of the top level support bar 80, while the second end of the side support bar 106 is attached to the left mounting bracket 22. The first end of the side support bar 108 is attached to the outer side of the top level support bar 82 near the first side of the top level support bar 82, while the second end of the side support bar 108 is attached to the right mounting bracket 24. The length of each of the side support bars 106 and 108 is fixed, as it is just designed to keep the apparatus 2 level when it is holding a heavy object.

Figure 5:
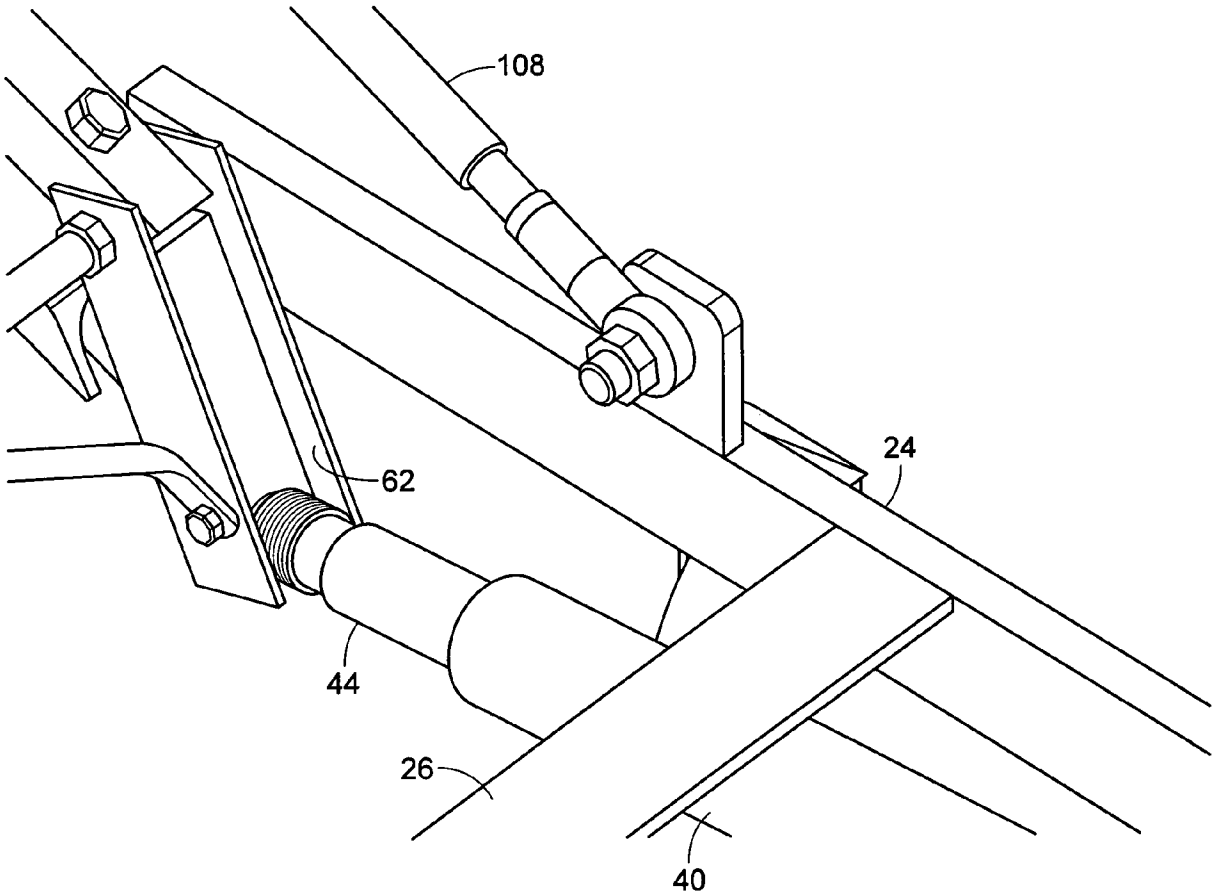
FIG. 5 shows a close-up perspective view showing the connectivity between a hinge element to a rod within a cylinder.

FIG. 5 shows a close-up perspective view showing the connectivity between hinge element 62 to rod 44 within cylinder 40.

Figure 6:
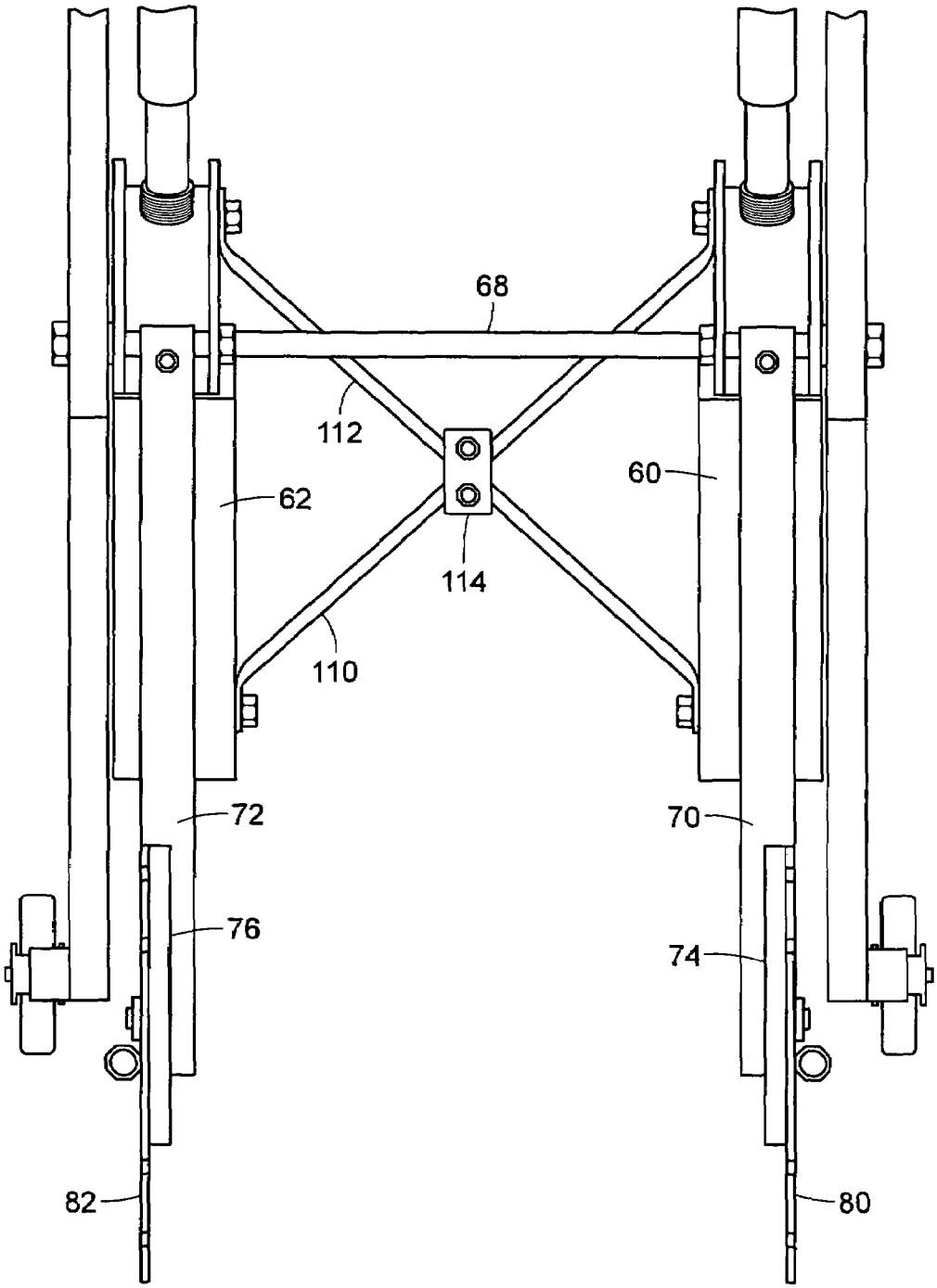
FIG. 6 shows a top view of the pair of stabilizer bars.
Figure 7:
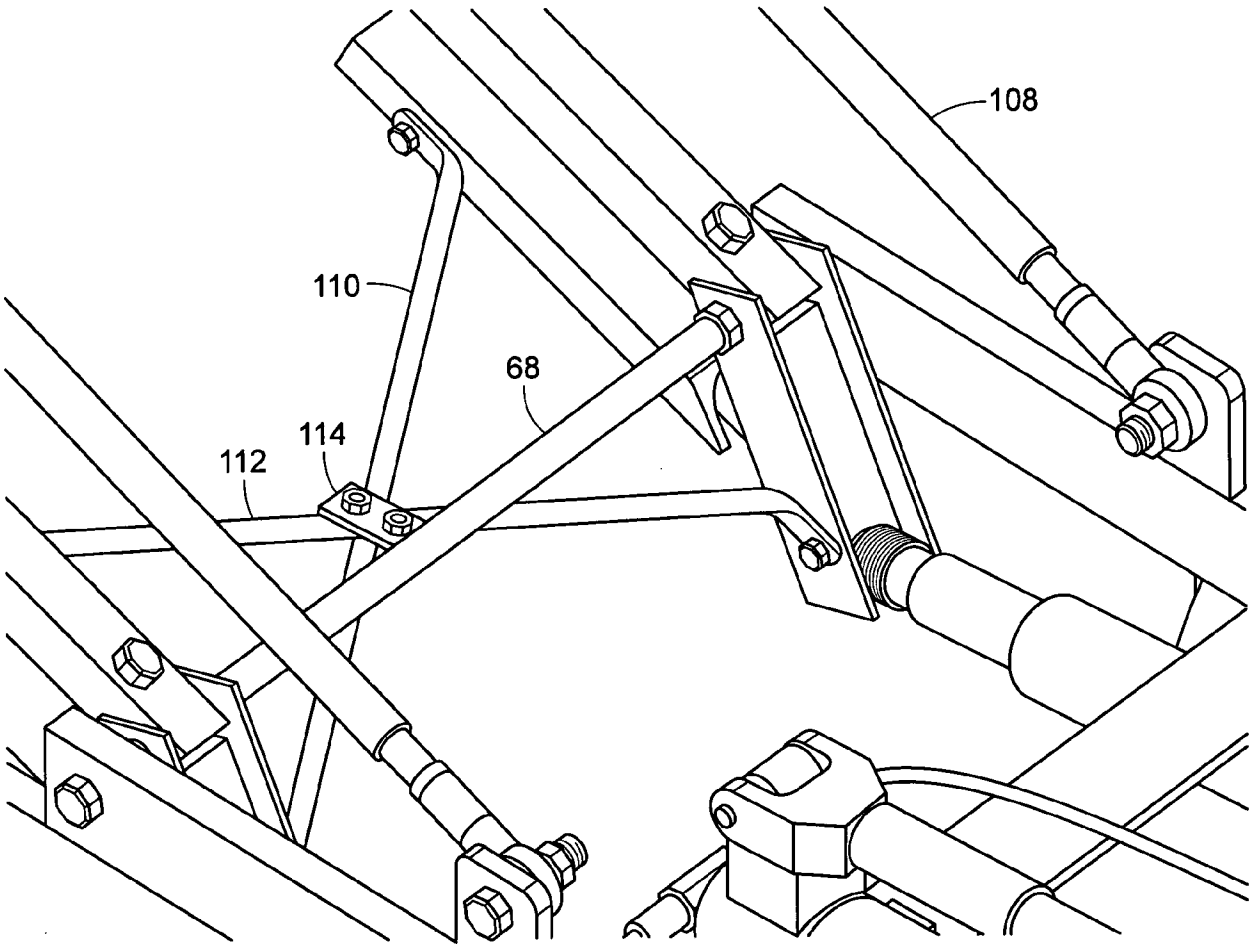
FIG. 7 shows a perspective view of the pair of stabilizer bars.

FIGS. 6 and 7 show top and perspective views, respectively, of the stabilizer bars 110 and 112. The stabilizer bars 110 and 112 are essentially set up in an X-pattern and bolted against the side of the inner side of the hinge elements 60 and 62. A connector plate 114 attaches the two stabilizer bars 110 and 112 to one another. The main purpose of the stabilizer bars 110 and 112 is to ensure that bars 70 and 72 are in unison when the apparatus 2 is raised and lowered.

Figure 8:
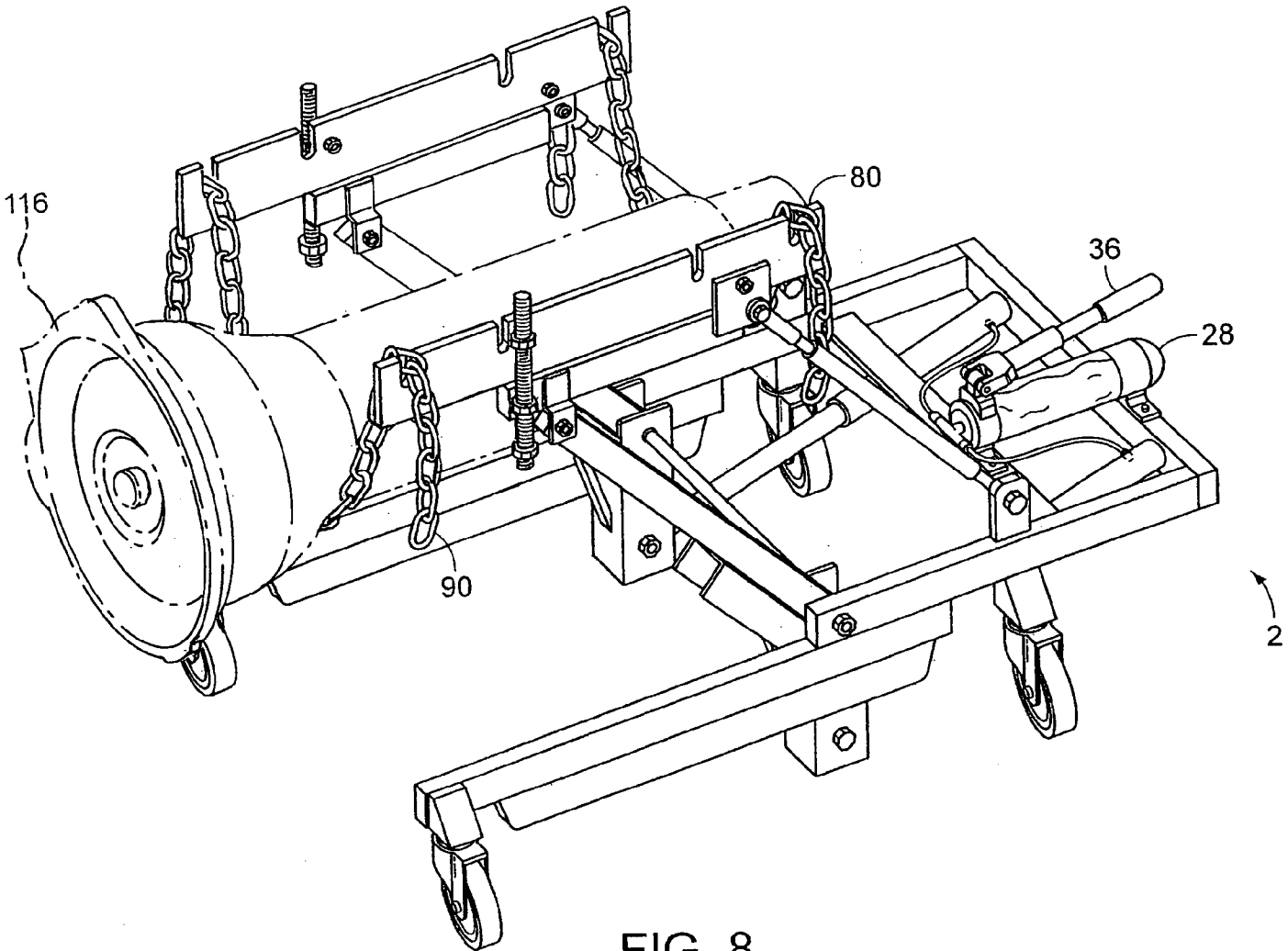
FIG. 8 shows how the apparatus is holding a transmission or other heavy object.

FIG. 8 shows how the apparatus is holding a transmission 116. To get into this position, the lever 36 on the hydraulic pump 28 is turned and downward pressure is placed on the top level support bars, causing all the support bars to compress, as seen in FIG. 1A. Then, the apparatus 2 is placed so that the two vertical layers of support bars are on either side of a transmission on a floor surfaced. Then, a pair of chains 90 are draped over various ovaloid grooves 88 on the top level support bars 80 and 82. Because the ovaloid grooves' shape, the chain is "stuck" in the position set. The chains would be configured to wrap underneath crucial holding points on the transmission 116 and also be configured so that there is no slack in each chain 90.

Then, the lever 36 on the pump 28 would be pumped downward and upward in a repetitive manner. As previously described, each individual "pumping motion" on the pump 28 sends a small volume of hydraulic fluid 34 located within the hydraulic pump 28 through tubes 46 and 48 and into the internal cavities 50 of the cylinders 38 and 40. This causes the rods 44 to push outward, turning each of the hinge elements. The turning of each of the hinge elements in the manner discussed causes the entire network of support bars to slowly "rise" with each pumping motion on the lever 36 of pump 28, causing the transmission 116 to slowly rise off of the floor. The presence of the lifting arms allow for easy mobility of the transmission 116 or other heavy object once it is sufficiently off of the ground surface. They also allow for easy placement of the transmission 116 or other heavy object back to a desired location after it has been serviced.

In various alternative embodiments of the present invention, the hydraulic pump 28 and the cylinders 38 and 40 can have different sizes and can also be placed in different positions on the apparatus 2. One of the important determining factors as to size of the hydraulic pump 28 and the cylinders 38 and 40 is what the desired use of the present invention would be.

What I claim as my invention is:

1. An apparatus for raising and lowering heavy objects between a floor surface and a higher elevation comprising:

(a) a bottom frame having two ends, a front end and a rear end, the bottom frame also having two sides, a left side and a right side, the bottom frame further comprising a support frame and a mounting frame, the support frame comprising a left bar and a right bar, with each bar having two ends, a first end and a second end, the second end of each bar being fixedly attached to the mounting frame, the mounting frame having the shape of a U-shape bracket and comprising a front mounting bracket, a left mounting bracket, and a right mounting bracket, each of the brackets of the mounting frame having two ends, a first end and a second end, each of the brackets of the mounting frame also having two side surfaces, a top side surface and a bottom side surface, each of the brackets of the mounting frame also having two sides, an inner side and an outer side, the second end of the left mounting bracket being fixedly attached to the first end of the front mounting bracket, the second end of the right mounting bracket being fixedly attached to the second end of the front mounting bracket, the left mounting bracket and right mounting bracket being parallel to one another, the second end of the left bar being fixedly attached to the bottom side surface of the left mounting bracket, the second end of the right bar is fixedly attached to the bottom side surface of the right mounting bracket, (b) a quartet of wheels comprising a first wheel, a second wheel, a third wheel, and a fourth wheel, the first wheel attached to the first end of the left bar, the second wheel attached to the first end of the right bar, the third wheel attached to the bottom side surface of the left mounting bracket, and the fourth wheel attached to the bottom side surface of the right mounting bracket, (c) a support bracket having two ends, a first end and a second end, the support bracket further having two side surfaces comprising a top side surface and a bottom side surface, the first end of the support bracket is attached to the inner side of the left mounting bracket, the second end of support bracket attached to the inner side of the right mounting bracket, (d) a hydraulic pump mounted on the top side surface of support bracket and the top side surface of front mounting bracket, the pump having two ends, a first end and a second end, the first end having an opening, (e) a T-joint connected to the opening on the hydraulic pump, (f) a volume of hydraulic fluid located within the hydraulic pump, (g) a lever having two ends, an attached end and a free end, the attached end of the lever being attached to the hydraulic pump near the first end of the hydraulic pump, (h) a pair of cylinders comprising a first cylinder and a second cylinder, each cylinder having two ends, a first end and a second end, the second end of each cylinder attached to the front mounting bracket, the first end of each cylinder having an opening, (i) a pair of rods comprising a first rod and a second rod, each rod having two ends, a first end and a second end, the first end of the first rod being inserted into the opening on the first end of the first cylinder, the first end of the second rod being inserted into the opening on the first end of the second cylinder, (j) a cavity located within each cylinder that is adjacent to the rod inserted within a particular cylinder, each cavity located near the second end of the cylinder, (k) a pair of tubes comprising a first tube and a second tube, each tube having two ends, a first end and a second end, the first end of each tube connected to the T-joint, the second end of the first tube attached to the first cylinder near the second end of the first cylinder, and the second end of the second tube attached to the second cylinder near the second end of the second cylinder, (l) a pair of hinge elements comprising a first hinge element and a second hinge element, the second end of the first rod attached to the first hinge element, the second end of the second rod attached to the second hinge element, (m) a hinge mounting rod having two ends, a first end and a second end, the first end of the hinge mounting rod attached to the first hinge element, the second end of the hinge mounting rod attached to the second hinge element, (n) a plurality of support bars, the plurality of support bars being an even number of support bars, at least one of the support bars attached to the left hinge element, at least one of the supports attached to the right hinge element, (o) wherein an individual can place a heavy object on top of the plurality of support bars, and (p) further wherein an individual can adjust the height of the plurality of support bars upward or downward by using the hydraulic pump and the pair of cylinders to raise or lower the plurality of support bars.

2. An apparatus for raising and lowering heavy objects between a floor surface and a higher elevation according to claim 1 wherein the plurality of support bars numbers six.

3. An apparatus for raising and lowering heavy objects between a floor surface and a higher elevation according to claim 2 wherein the each of the wheels of the plurality of wheels is a rotatable wheel.

4. An apparatus for raising and lowering heavy objects between a floor surface and a higher elevation according to claim 2 wherein the each of the wheels of the plurality of wheels is a castor wheel.

* * * * *